US005699225A

United States Patent [19]

Yavitz et al.

[11] Patent Number: 5,699,225

[45] Date of Patent: Dec. 16, 1997

[54] COMBINED WORK PLATFORM AND PERSONAL COMPUTER SYSTEM HAVING A REFLECTIVE DISPLAY PANEL

[76] Inventors: Edward Q. Yavitz; Adam Yavitz, both of 3828 Spring Creek Rd., Rockford, Ill. 61114

[21] Appl. No.: 691,546

[22] Filed: Aug. 2, 1996

[51] Int. Cl.[6] ..... G06F 1/16; H05K 5/00; A47B 81/06

[52] U.S. Cl. ..... 361/683; 361/682; 108/50; 312/223.3

[58] Field of Search ..... 108/50; 312/194, 312/196, 231, 223.1, 223.3, 223.6; 364/708.1; 361/680–683; 348/836

[56] References Cited

U.S. PATENT DOCUMENTS

| | | | |
|---|---|---|---|
| 2,509,508 | 5/1950 | Kalff et al. | 348/836 X |
| 4,831,449 | 5/1989 | Kimura | 348/836 X |
| 4,922,060 | 5/1990 | McJunkin | 345/163 X |
| 5,262,926 | 11/1993 | Hall | 361/681 |
| 5,294,193 | 3/1994 | Wegman et al. | 312/223.3 |
| 5,368,377 | 11/1994 | Baines | 312/194 X |

*Primary Examiner*—Michael W. Phillips
*Attorney, Agent, or Firm*—Robert A. Van Someren

[57] ABSTRACT

A work station is disclosed that combines a work platform with a personal computer. The monitor of the personal computer is located beneath the upper surface of the work platform to provide easy use of the computer without taking up space or obstructing the view of the user when not in use. The monitor is oriented to cooperate with a pivotable reflector system that reflects visual information displayed on the monitor to a person sitting at the work station.

20 Claims, 4 Drawing Sheets

COMBINED WORK PLATFORM AND PERSONAL COMPUTER SYSTEM HAVING A REFLECTIVE DISPLAY PANEL

FIELD OF THE INVENTION

The present invention relates generally to workstations, such as desks, and particularly to work stations that are used in conjunction with a personal computer.

BACKGROUND OF THE INVENTION

A wide variety of workstations, such as desks, tables and other work platforms, are used by individuals both in the office and at home. Many of those individuals also use or have access to a personal computer. Typically, the personal computer sits atop the work platform, taking up a substantial amount of work space.

To some extent, certain components of the computer, such as the hard drive, can be located elsewhere, but at least the monitor remains on top of the work platform to permit viewing of the visual information being displayed. It would be advantageous to conserve work space and provide a more aesthetically pleasing work station by removing the monitor from the work platform while permitting selective viewing of the displayed information.

SUMMARY OF THE INVENTION

The present invention relates to a system for providing a more aesthetically pleasing workstation and saving space on a work platform while facilitating the use of a personal computer. According to a preferred embodiment of the invention, the system includes a work platform lying along a plane. The work platform includes a top work surface, a back region, and a front region.

The system can also include a personal computer having a monitor for displaying visual information. The personal computer is configured to display information on the monitor as a mirror image transposed along the x-axis of the monitor. Additionally, a mounting structure is disposed to hold at least a substantial portion of the monitor beneath the work surface at an angle with respect to the plane in which the work platform lies. The displayed information is thereby projected back at an angle along a projection line towards a reflector. The reflector is disposed to intersect the projection line and oriented to reflect the displayed information back in a normal readable orientation toward a user sitting along the front region of the work platform.

In one specific embodiment, the work platform includes an opening therethrough and the monitor is disposed below the top work surface of the work platform proximate the opening. In this embodiment, the reflector includes a reflector panel mounted on a hinge adjacent the opening. Thus, the reflector panel can be folded downwardly into the work platform opening when not being used.

Another aspect of the invention includes a method for providing information through a monitor of a personal computer while preserving space at a work station. The method includes providing a work platform having an upper work surface. A region is created in the work platform that permits passage of light through the work platform. A mounting structure is located in proximity to the region to permit the monitor to be held at least partially and preferably completely, beneath the work surface. A reflector system is then mounted in cooperation with the region such that visual information from the monitor can be reflected toward a person working at the work platform.

BRIEF DESCRIPTION OF THE DRAWINGS

The invention will hereafter be described with reference to the accompanying drawings wherein like reference numerals denote like elements, and.

DETAILED DESCRIPTION OF THE PREFERRED EMBODIMENT

Figure 1:
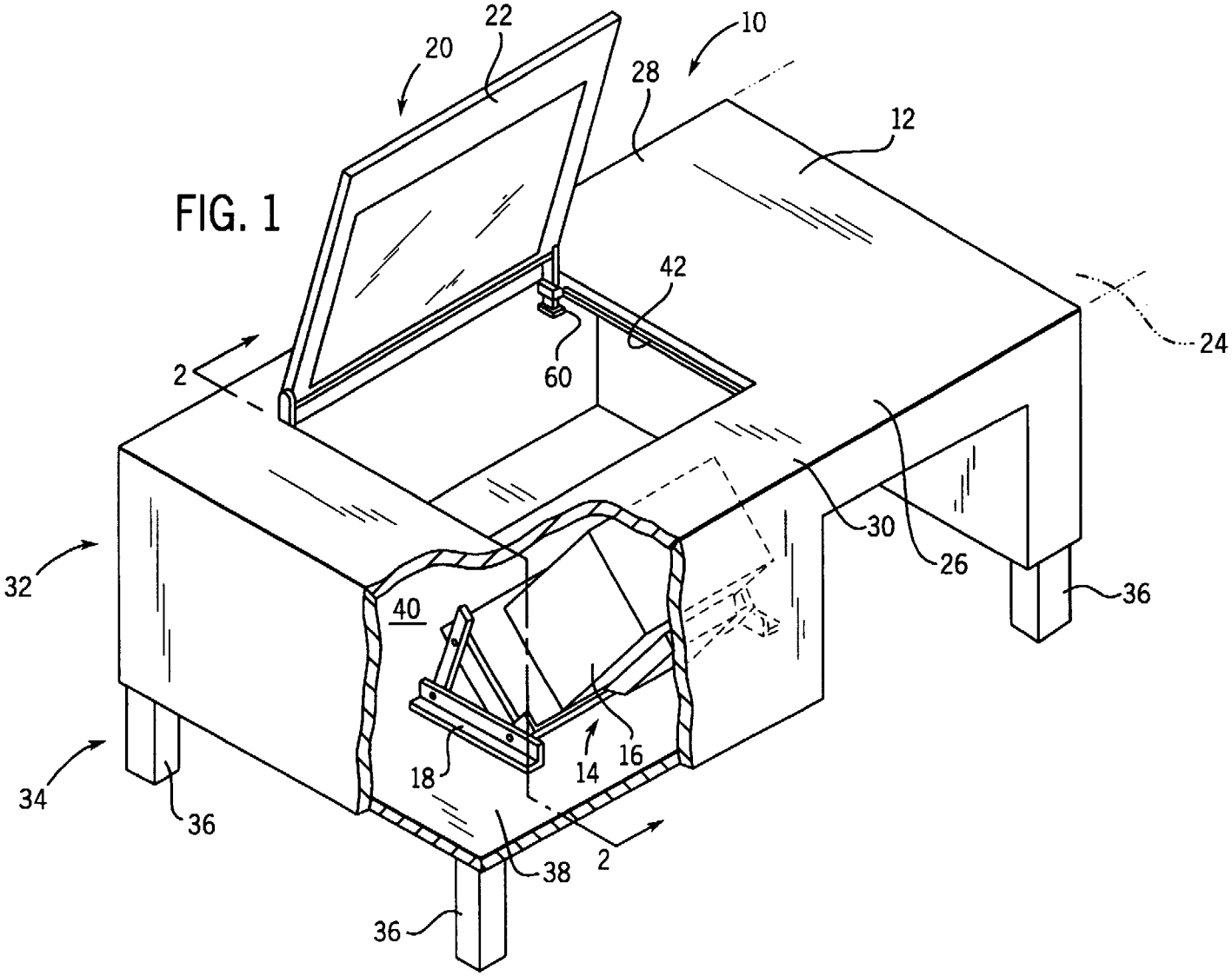
FIG. 1 is a perspective view of a work station, such as a desk, combined with a recessed monitor.
Figure 2:
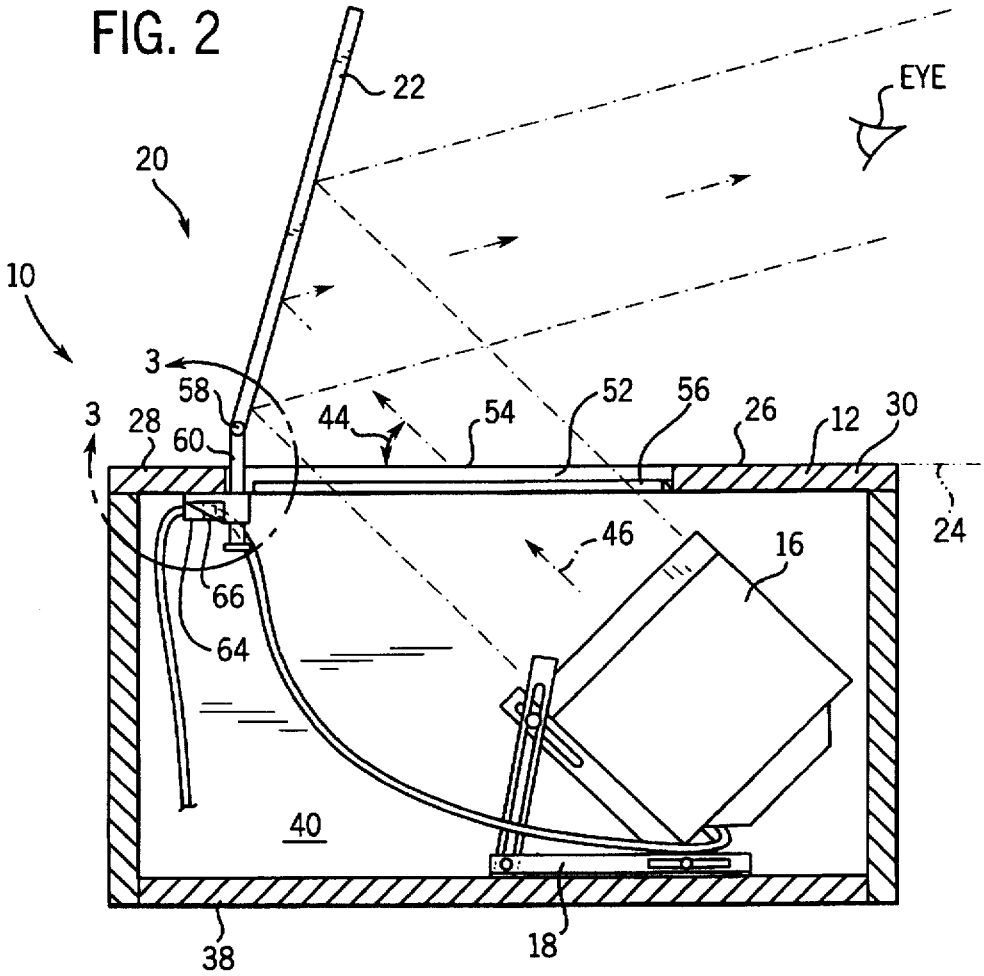
FIG. 2 is a cross sectional view taken generally along line 2—2 of FIG. 1.

Referring generally to FIGS. 1 and 2, a system 10, according to a preferred embodiment of the invention, is illustrated. System 10 includes a work platform 12, a personal computer 14 having a monitor 16, a mounting structure 18 and a reflector 20. Reflector 20 preferably comprises a single reflective panel 22, but it could include two or more panels used to direct and redirect the visual information displayed on monitor 16.

Work platform 12 lies generally along a plane 24 and includes a top work surface 26, a back region 28, and a front region 30. In the illustrated embodiment, work platform 12 is part of a desk 32. Desk 32 includes a base 34, shown by way of example as a plurality of legs 36. A bottom wall 38 is disposed at a distance from work platform 12 to create a cavity 40 for receiving monitor 16.

Although work platform 12 has been described as associated with a desk, it can include numerous other structures. For example, work platform 12 can be a counter top, a table top or other platforms. Preferably, work platform 12 includes an opening 42 formed therethrough. The opening is located to cooperate with monitor 16 and serves as a region where the displayed visual information can pass through work platform 12 towards reflector panel 22.

Mounting structure 18 is designed to hold monitor 16 proximate opening 42. In the illustrated embodiment, mounting structure 18 supports monitor 16 on bottom wall 38. However, mounting structure 18 could also suspend monitor 16 from work platform 12. In either event, at least a substantial portion of monitor 16 is held below top work surface 26, and preferably the monitor is held completely below top work surface 26 as illustrated in FIG. 1.

In the illustrated embodiment, mounting structure 18 holds monitor 16 at a desired angle 44 with respect to plane 24. (See FIG. 2) Thus, the information displayed on monitor 16 is projected back at angle 44 along a projection line 46. Reflector 20, and more specifically reflector panel 22, is disposed to intersect projection line 46 and reflect the displayed information back towards a user sitting along front region 30 of work platform 12. Reflector panel 22 is thus preferably disposed proximate opening 42, as illustrated.

Because monitor 16 is turned away from the user and the displayed information is reflected toward the user, the information displayed on monitor 16 must be reversed or transposed along the x-axis of the monitor and projected as a mirror image. In other words, when looking directly at the displayed information on monitor 16, the text would read from right to left in a mirror image format. However, when the monitor is reversed and the displayed information is projected against reflective panel 22, the displayed information will appear in a normal, readable orientation to a user sitting at work platform 12. The displayed information can be reversed and placed in a mirror image in a variety of ways, including software changes to the monitor driver 48 or hardware changes to video card 50. (See FIG. 4) However, the changes could most easily be made using translation matrix software as would be understood by one of ordinary skill in the art.

Preferably, a window 52 is disposed in opening 42. Window 42 can be constructed from a variety of optical glass or plastic based materials that permit information displayed on the screen of monitor 16 to be projected therethrough with minimal distortion. Window 52 can also be designed to produce desirable optical effects. For example, window 52 can be constructed as a lens to magnify the data projected from monitor 16 to reflector 20. Additionally, window 52 can be mounted so that its upper surface 54 is flush with top work surface 26 of work platform 12. However, in many applications, it is preferred that window 52 be disposed below top work surface 26 to create a recess 56. Recess 56 is designed to receive reflective panel 22 when folded downwardly.

Figure 3:
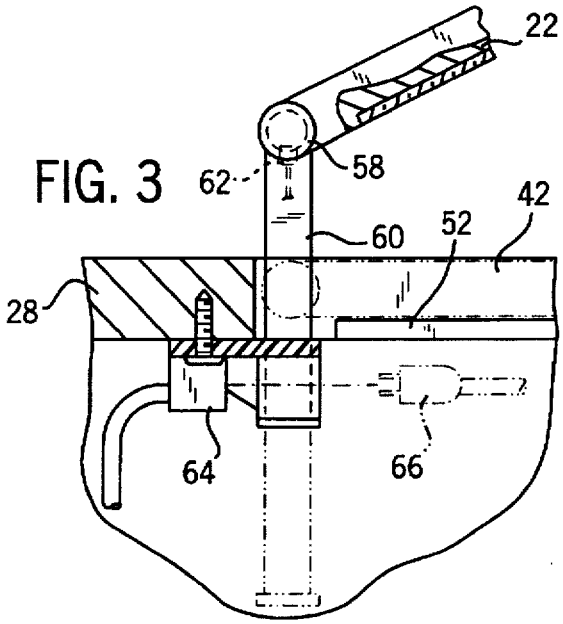
FIG. 3 is an enlarged partial cross sectional view of the hinge shown in FIG. 2.

As best illustrated in FIG. 3, reflective panel 22 preferably is mounted on a hinge 58. Optionally, panel 22 is mounted on an adjustment mechanism 60, such as the friction slide illustrated. Reflective panel 22 can be slid downwardly until hinge 58 rests in recess 56, and then folded down into recess 56 to create a generally flat top work surface 26 across the entire work platform 12.

It should also be noted with reference to FIGS. 2 and 3, both mounting structure 18 and reflector 20 can be constructed to provide adjustability. Thus, the height of reflective panel 22 can be adjusted and the projection angle 44 can be increased or decreased according to the preference of the user.

Optionally, a switch 62 is connected to hinge 58. Switch 62 can be connected intermediate monitor 16 and a power source (not shown) to automatically provide power to monitor 16 when reflective panel 22 is lifted to an upright position as illustrated in FIG. 2. Switch 62 could also be a double pull type switch connected to the monitor and other components of the personal computer 14. Switch 62 preferably is connected to a plug connection 64 designed to receive a plug 66 electrically coupled to monitor 16.

Figure 4:
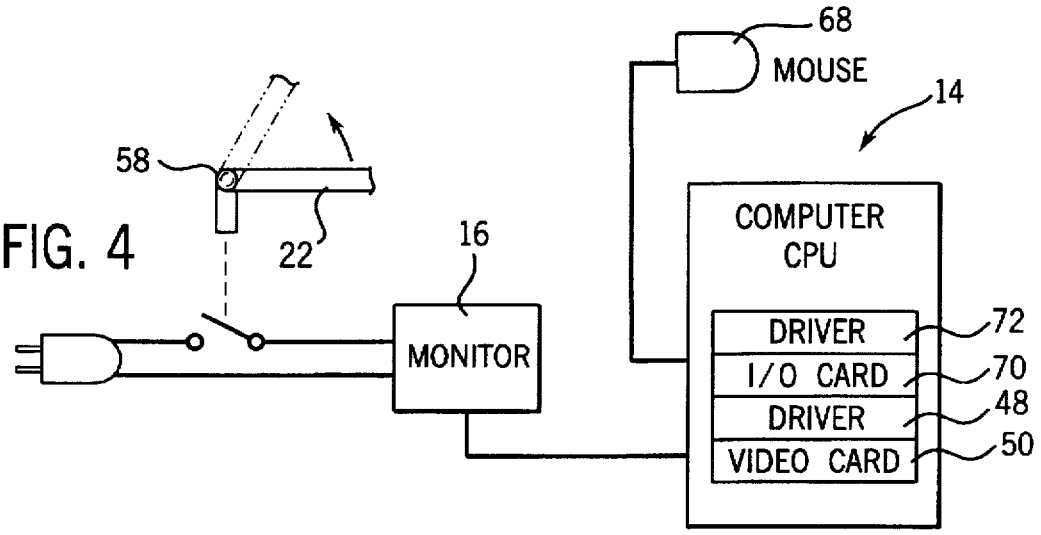
FIG. 4 is a schematic representation of a personal computer connected to the reflector system illustrated in FIG. 1.

As shown in FIG. 4, personal computer 14 can also include a mouse 68. Mouse 68 would typically be coupled to personal computer 14 through an input/output card 70. As is well known, movement of mouse 68 provides corresponding movement of a curser about the screen of monitor 16. However, when monitor 16 projects displayed information back towards reflective panel 22 as illustrated best in FIG. 2, movement of a conventional mouse to the left will appear to move the curser to the right when the user views reflective panel 22. Accordingly, to accommodate the requisite reversing of displayed information as described above, it is necessary to adjust the mouse so that movement of the mouse to the right appears to move the curser to the right along reflective panel 22. This can be accomplished, for example, by making a software change in the driver 72 associated with mouse 68.

Figure 5:
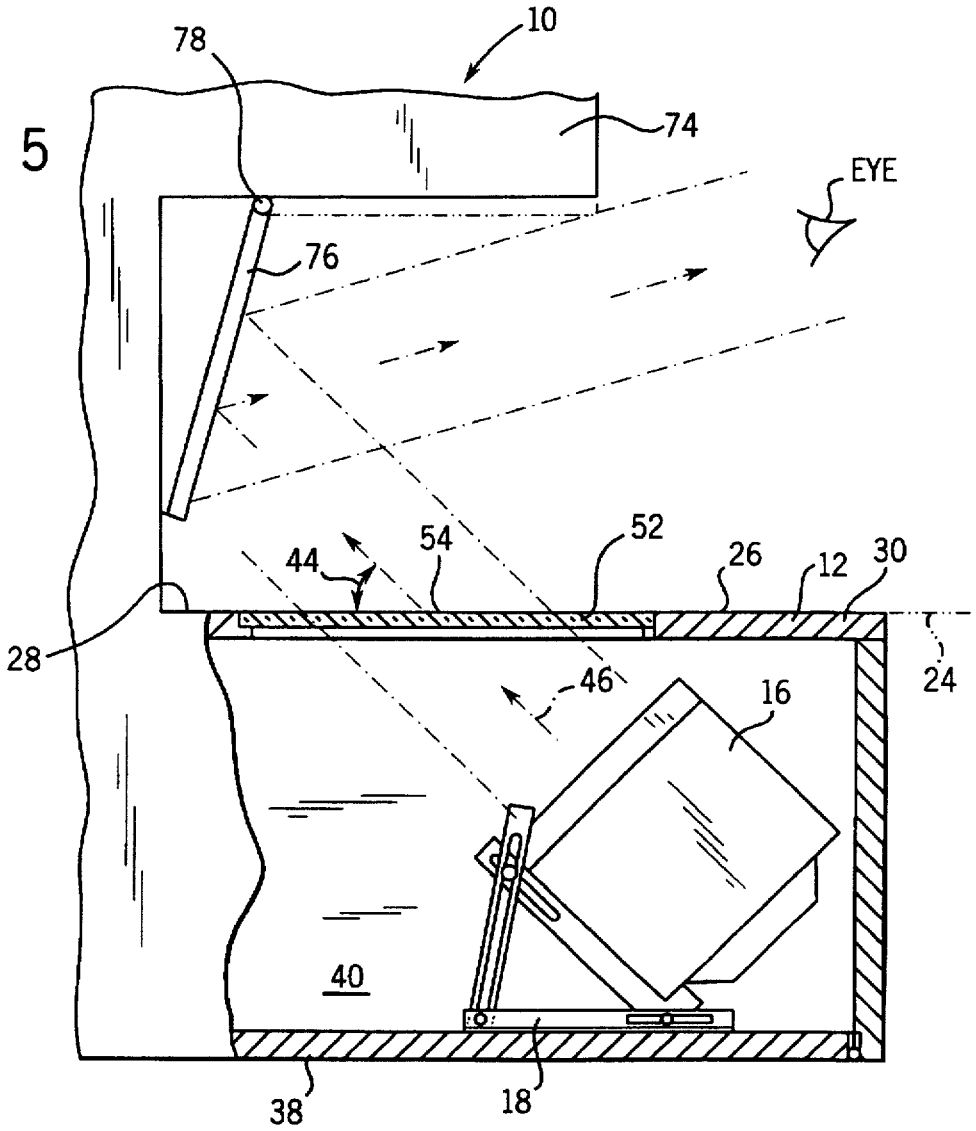
FIG. 5 is a cross sectional view similar to that shown in FIG. 2, but showing an alternate embodiment of the present invention.
Figure 6:
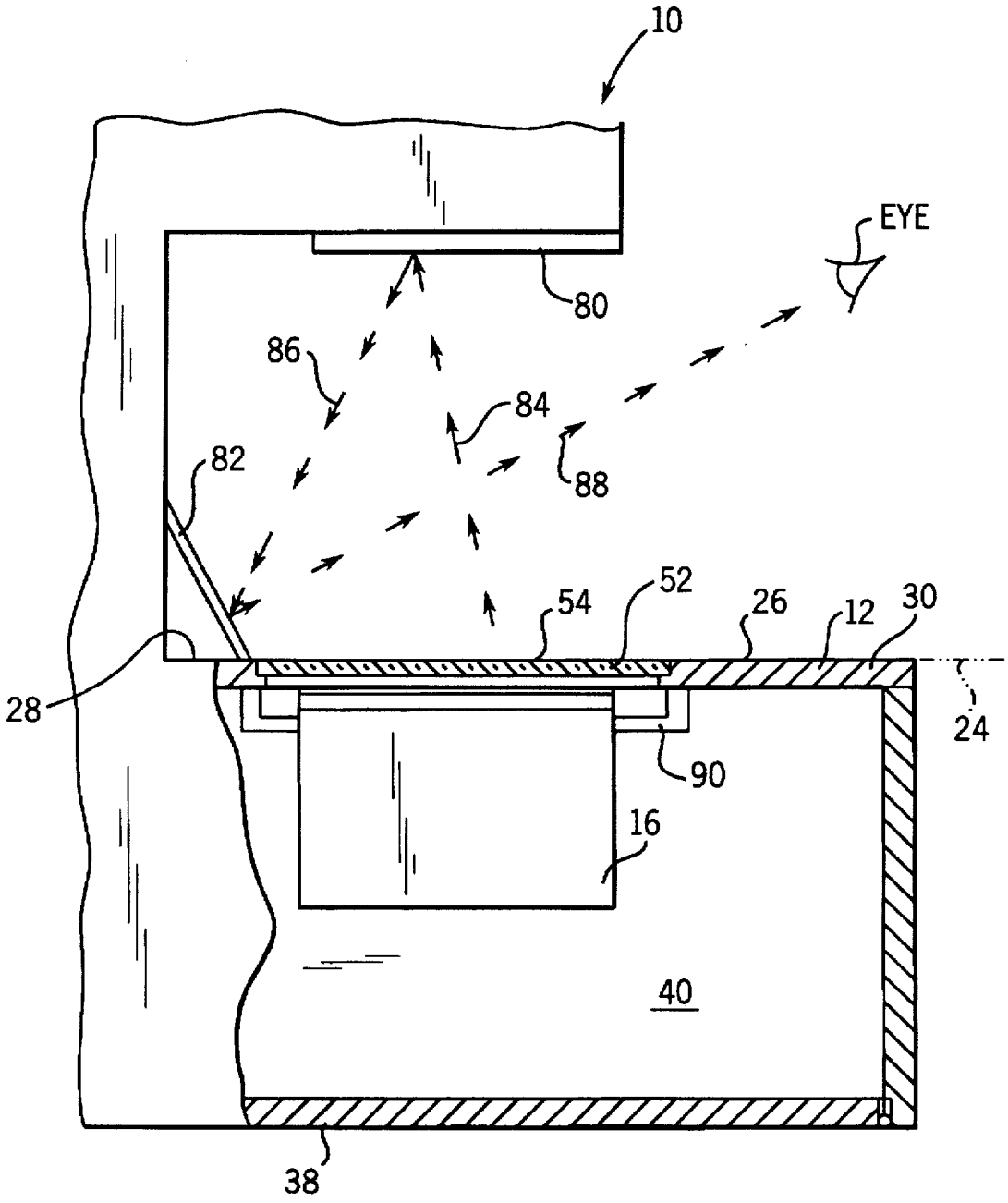
FIG. 6 is a cross sectional view similar to that shown in FIG. 5, but showing the use of a plurality of reflector panels.

Alternate embodiments of system 10 are illustrated in FIGS. 5 and 6. In these Figures, elements matching the elements of FIGS. 1–4 will be labelled with the same reference numerals. Referring specifically to the alternate embodiment illustrated in FIG. 5, the primary difference in this design is placement of reflector 20. As shown, an overhanging portion 74 extends at least partially over work platform 12. A single reflective panel 76 is suspended from overhanging portion 74, preferably by a hinge member 78. Thus, the reflective panel is removed entirely from the top work surface 26.

Another alternative embodiment is that illustrated in FIG. 6. In this embodiment, reflector 20 includes a first reflector panel 80 and a second reflector panel 82. Preferably, reflector panel 80 is mounted generally above opening 42 of work platform 12, and reflector panel 82 is disposed towards the back region 28 of work platform 12. Reflector panels 80 and 82 are oriented in cooperation with monitor 16 so information displayed by monitor 16 is projected upward along a projection line 84 towards reflector panel 80. Reflector panel 80 then reflects the displayed information along a second projection line 86 towards second reflector panel 82. The second reflector panel 82 is oriented to reflect the displayed information along a third projection line 88 toward a location where it can be viewed by the system user. In this embodiment, it may be advantageous to suspend monitor 16 from work platform 12 by a suspension bracket 90. Of course, the orientation of the information displayed on the monitor and movement of the curser in response to movement of the mouse must be adjusted according to the specific orientation of monitor 16 and the number of reflector panels used in the specific application.

It will be understood that the foregoing description is of preferred, exemplary embodiments, and the scope of the invention is not limited to the specific embodiments described. For example, a variety of work platforms can be used in cooperation with a variety of computer systems, the reflector may include two or more reflector panels to direct and redirect information displayed on the monitor, the reflector panels as well as the monitor can be adjustably mounted or fixed in place by a variety of mounting structures depending on the specific application. These and other modifications can be made without departing from the scope of the invention as set forth in the appended claims.

We claim:

1. A system for saving space while facilitating the use of a personal computer by a user, comprising:

a work platform lying along a plane, the work platform including a top work surface, a back region and a front region;

a personal computer including a monitor for displaying visual information, the personal computer being configured to produce a transposed mirror image of the displayed information on the monitor;

a mounting structure disposed to hold at least a substantial portion of the monitor beneath the work surface at an angle with respect to the plane such that the display information is projected back at the angle along a projection line; and a reflector disposed to intersect the projection line, the reflector being oriented to reflect the displayed information back towards the user in a normal readable orientation.

2. The system as recited in claim 1, wherein the work platform includes an opening therethrough, the opening being disposed to permit passage of the displayed information through the work platform.

3. The system as recited in claim 2, further comprising a window disposed within the opening.

4. The system as recited in claim 3, wherein the window includes an upper surface coplanar with the top work surface.

5. The system as recited in claim 1, wherein the reflector includes a reflective panel pivotably mounted on a hinge member to permit pivoting of the reflective panel towards and away from the projection line.

6. The system as recited in claim 5, further comprising a switch coupled between the hinge and the monitor to automatically turn on the monitor when the reflective panel is pivoted into intersection with the projection line.

7. The system as recited in claim 6, wherein the hinge member includes a hinge mounted to the work platform.

8. The system as recited in claim 7, wherein the work platform includes an opening therethrough and a window disposed within the opening, the window being located beneath the top work surface to create a recess to receive the reflective panel.

9. The system as recited in claim 8, wherein the window comprises as lens to enlarge the displayed information.

10. The system as recited in claim 1, wherein the personal computer includes a mouse adapted to direct the movement of an indicator on the monitor.

11. The system as recited in claim 10, wherein the personal computer is configured such that the indicator moves laterally across the monitor in the opposite direction of the movement of the mouse.

12. A desk for use with a personal computer, comprising:

a base;

a work platform mounted on the base, the work platform including a front region, a back region, a top work surface and an opening;

a mounting structure capable of holding a monitor of the personal computer at least partially beneath the top work surface in proximity to the opening; and a reflector system disposed to cooperate with the opening such that information on the monitor is reflected towards a person sitting proximate the front region of the work platform.

13. The desk as recited in claim 12, wherein the base includes four legs.

14. The desk as recited in claim 12, wherein the reflector system includes a reflector panel mounted to the work platform proximate the opening.

15. The desk as recited in claim 14, wherein the reflector system includes a hinge, the hinge being attached to the reflector panel and the work platform.

16. The desk as recited in claim 15, further comprising a switch connected to the hinge, the switch being electrically connectable to the monitor to power the monitor when the reflector panel is moved to a work position.

17. The desk as recited in claim 15, further comprising a window disposed in the opening below the top surface to create a recess, the recess being sized to receive the reflector panel.

18. A method for providing information through a monitor of a personal computer while preserving a work surface by obviating the need to retain the monitor on the work surface, comprising the steps of:

providing a work platform having an upper work surface;

creating a region in the work platform that permits passage of light through the work platform;

locating a mounting structure in proximity to the region, the mounting structure being constructed to hold the monitor at least partially beneath the work surface;

mounting a reflector system in cooperation with the region such that visual information from the monitor can be reflected toward a person working at the work platform.

19. The method as recited in claim 18, further comprising the steps of:

mounting a monitor to the mounting structure; and orienting the monitor such that it will project visual information toward the reflector system.

20. The method as recited in claim 19, wherein the step of mounting a reflector system includes the step of pivotably mounting a reflector panel to the work platform.

* * * * *